US007254010B1

(12) United States Patent
Hardy

(10) Patent No.: US 7,254,010 B1
(45) Date of Patent: Aug. 7, 2007

(54) METHOD AND APPLIANCE FOR PROVIDING BROADBAND INTERNET SERVICES IN A RETRACTING DRAWER MOUNTED ENCLOSURE

(75) Inventor: Jay Scott Hardy, Seattle, WA (US)

(73) Assignee: broadbandappliance.com, San Carlos, CA (US)

( * ) Notice: Subject to any disclaimer, the term of this patent is extended or adjusted under 35 U.S.C. 154(b) by 370 days.

(21) Appl. No.: 10/876,060

(22) Filed: Jun. 24, 2004

(51) Int. Cl.
*H05K 5/00* (2006.01)

(52) U.S. Cl. ..... 361/679; 361/683; 361/686

(58) Field of Classification Search ..... 361/679–686
See application file for complete search history.

(56) References Cited

U.S. PATENT DOCUMENTS

| | | | | |
|---|---|---|---|---|
| 5,267,127 | A | 11/1993 | Pollitt | |
| 5,400,408 | A | 3/1995 | Lundgren et al. | |
| 5,571,256 | A | 11/1996 | Good et al. | |
| 5,587,877 | A * | 12/1996 | Ryan et al. | 361/683 |
| 5,648,762 | A | 7/1997 | Ichimura et al. | |
| 5,762,409 | A | 6/1998 | Rice, Jr. | |
| 5,871,264 | A | 2/1999 | Ohara | |
| 6,158,829 | A | 12/2000 | Nielsen | |
| 6,480,372 | B1 | 11/2002 | Vong et al. | |
| 6,525,929 | B2 | 2/2003 | Carr | |
| 6,580,602 | B2 | 6/2003 | Zodnik | |
| 6,584,404 | B1 | 6/2003 | McBurney et al. | |
| 6,637,028 | B1 | 10/2003 | Voyticky et al. | |
| 6,646,863 | B1 | 11/2003 | White et al. | |
| 6,654,367 | B1 | 11/2003 | Kaufman | |
| 6,678,737 | B1 | 1/2004 | Bucher | |
| 6,688,518 | B1 | 2/2004 | Valencia et al. | |
| 6,711,419 | B1 | 3/2004 | Mori | |
| 7,042,716 | B2 * | 5/2006 | Shearman | 361/684 |
| 2001/0014008 | A1 | 8/2001 | Allirot | |
| 2001/0017761 | A1 | 8/2001 | Dirzik | |
| 2001/0030944 | A1 | 10/2001 | Kato | |
| 2002/0011032 | A1 | 1/2002 | Choi | |
| 2002/0078290 | A1 | 6/2002 | Derrico et al. | |
| 2002/0078445 | A1 | 6/2002 | Sharif et al. | |
| 2002/0104944 | A1 | 8/2002 | Pogatetz et al. | |
| 2002/0117315 | A1 | 8/2002 | Gabowner | |
| 2002/0156636 | A1 | 10/2002 | Ghen et al. | |
| 2003/0033148 | A1 | 2/2003 | Silverman et al. | |
| 2003/0097428 | A1 | 5/2003 | Afkhami et al. | |
| 2003/0149746 | A1 | 8/2003 | Baldwin et al. | |
| 2003/0158927 | A1 | 8/2003 | Sagey et al. | |
| 2003/0217110 | A1 | 11/2003 | Weiss | |
| 2004/0010653 | A1 | 1/2004 | Grundy et al. | |
| 2004/0054747 | A1 | 3/2004 | Breh et al. | |

OTHER PUBLICATIONS

Dave Salvator, "Low-Cost Home Media Shoot-Out" Extreme Tech. Jun. 18, 2003, p. 1-11, http: extremetech.com/print.article/0,1583,9=43588,00.asp.

(Continued)

*Primary Examiner*—Yean-Hsi Chang
(74) *Attorney, Agent, or Firm*—Jay S. Hardy

(57) ABSTRACT

The invention pertains to an Internet appliance, specifically one that provides in a single drawer mounted enclosure audio and computer functions. It provides for input means with a built-in keyboard or game console. The Internet appliance may be removed from the drawer slide and carried to another location and inserted into another drawer slide for portability.

12 Claims, 8 Drawing Sheets

OTHER PUBLICATIONS

Matthew Fordahl, "Multimedia PCS not at Home in Living Room" AP Technology Writer, Nov. 26, 10:10 pm ET.
Bill Howard, "HP Media Hub Shows Promise". Jan. 20, 2004. p. 1—PC Magazine—http://www.pcmag.com/print-article 10,3048,a=114973,00.asp.
Anonoymous—"Devise Profile: IceBox Flipscreen". Aug. 31, 2002. p. 1-3. http://windowsfordevises.com/articles/AT8826356583.html.
Frank Bajak, "Let the Music Play: Top Digital Receivers Stream Audio Files to Stereo". The Associated Press. p. 1-3. http:seattletimes.nwsource.com/cgi-bin/PrintStory. pl?docoment_id=13504795482section_1, Jan. 21, 2003.
Edward C. Baig, "Can You Cypher Hear Me Now? Net Calling Plans are Coming" p. 1-3, USA Today, http://usatoday.printthis. clickability.com/pt/ept?action=cpt&title=USATODAY.com+-+ ca . . .
Michael J. Miller. "The PC Innovations Just Don't Stop"Nov. 4, 2003. p. 1-3. PC Mag. http://www.pcmag.com/print_article/ 0,1761,a=111107,00.asp.
David Coursey: "How Microsoft Plans to Put the PC at the Heart of Your Home." Anchordesk, p. 1-3. Wednesday, Jan. 9, 2002.
Anonymous. "Wall Mounted Computer Mobile Medical Solutions." RDP. http://rdpdisplays.com/healthcare_static.htm.
John G. Spooner, "Home PCS to Gain Multimedia Savvy". pp. 1-3. CNET.com. May 3, 2004. http://news.com.com/2100-1041-5203521.html.
Mark Hachman. "Sharp Plans LCD TVs with PVR, Wi-Fi", ExtremeTech. pp. 1-2. Jan. 7, 2004. http://www.pcmag.com/ print_article/0,1761,a=115792,00.asp.
Joe Rudich, "Ethics the Bedroom Computer". p. 1-2. Mar. 1, 2001. Computer User. http://computeruser.com/articles/ 2003,3,4,1,0301,01.html.
Anonoymous. "Are Laptops the Next Desktops?" Mar. 5, Business Week Online p. 1-2.
W. David Gardener. "Report: Big Changes Coming for PCS". Jan. 27, 2004. Techweb News. pp. 1-2. http://news.yahoo.com/ news?tropl=story28cid=748u=/cmp/20040124/tc.cmp/17500849.
Alex Salkever. "The Many Shapes of Tomorrow's PC" Business Week Online. Nov. 4, 2003. 1-4. http.//yahoo.businessweek.com:/ print/technology/content/nov2003/tc2003114_2291_tc134.html.
Daniel Sorid. "PluggedIn: PC Makers Try Again with TV Computers." Mar. 2, 2004. Reuters. p. 1-2. U.S.A.
Steven Levy. "Twilight of the PC Era?" Newsweek. pp. 1-6. Nov. 26, 2003. http://www.msnbc.com/id/3474993/site/newsweek/.
Stephen Baker. "Big Bang!" Business Week Online. pp. 1-6. Jun. 21, 2004. http://yahoo.businessweek.com:/print/magazine/content/ 04-25/b3888601.htm?MZ.
Andrew Park. "Personal Computers" Business Week Online. pp. 1-3. Jun. 21, 2004. http://yahoo.businessweek.com:/print/magazine/ content/04-25/b3888622.htm?MZ.

* cited by examiner

Figure 1:
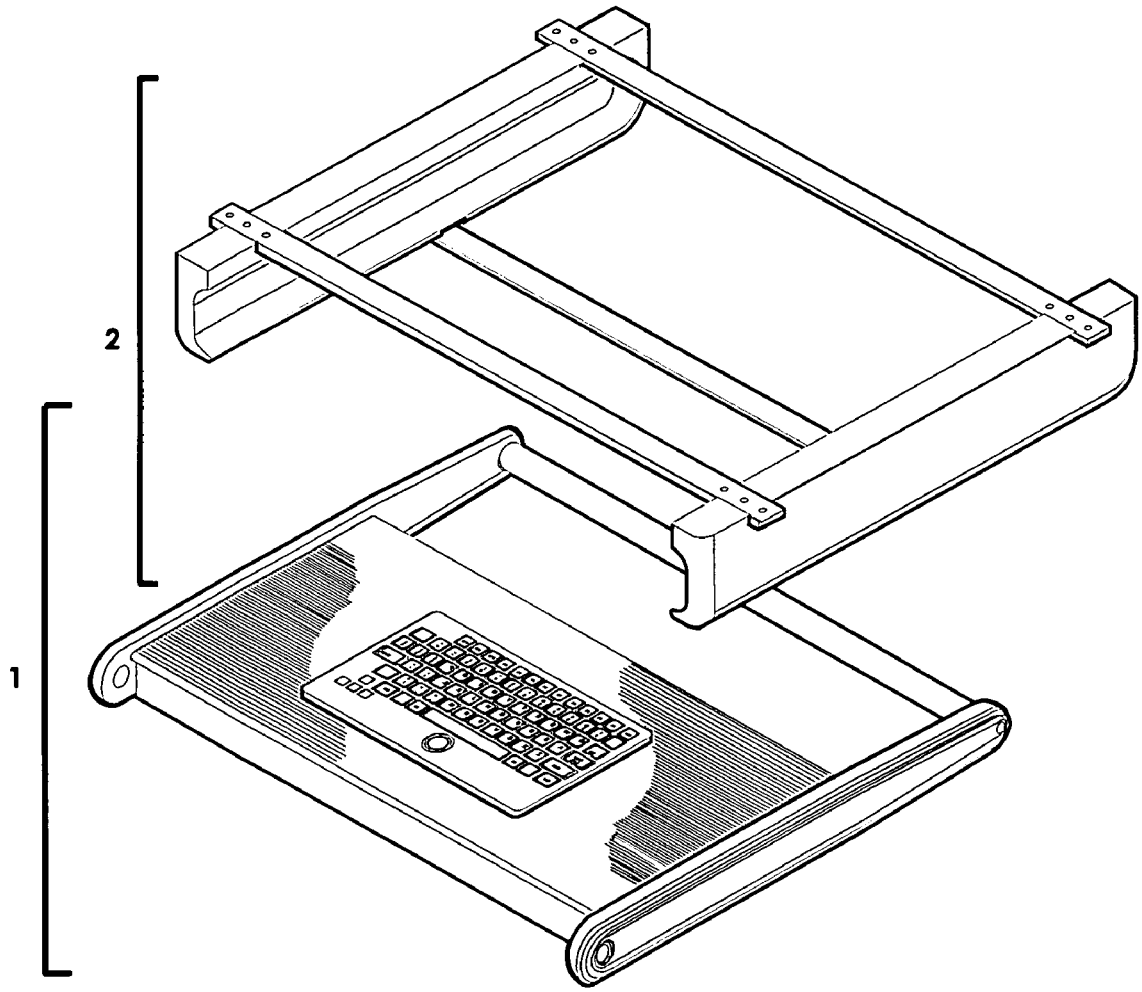

Figure 1: top, front, right-side perspective of this invention

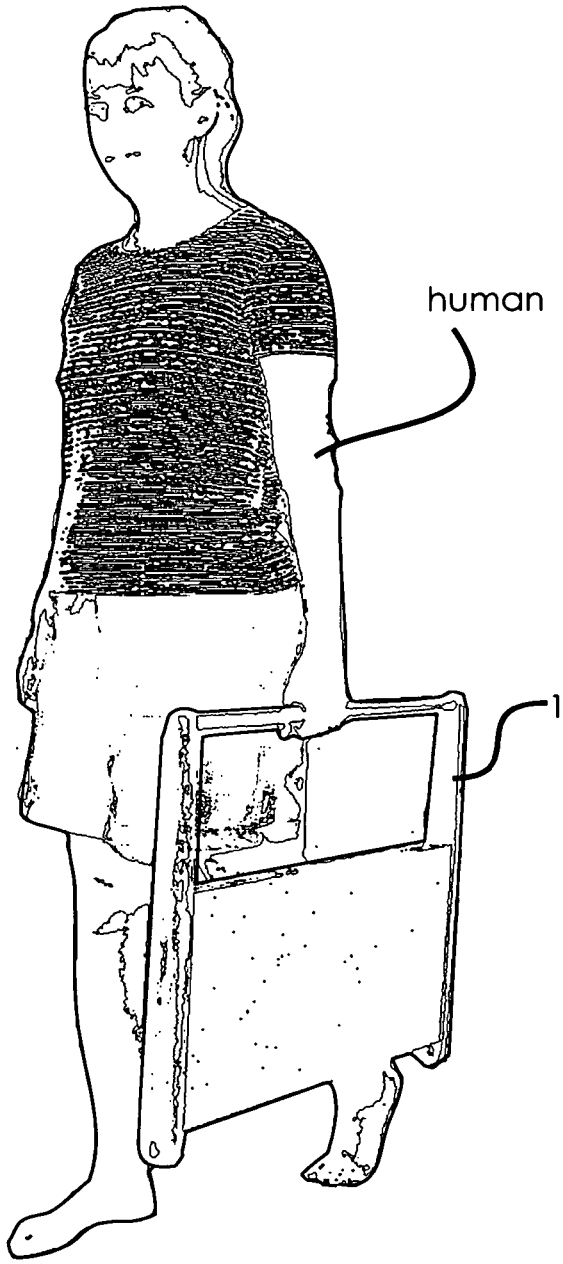
Figure 3: Perspective of invention of Figure 1 being carried by a user.

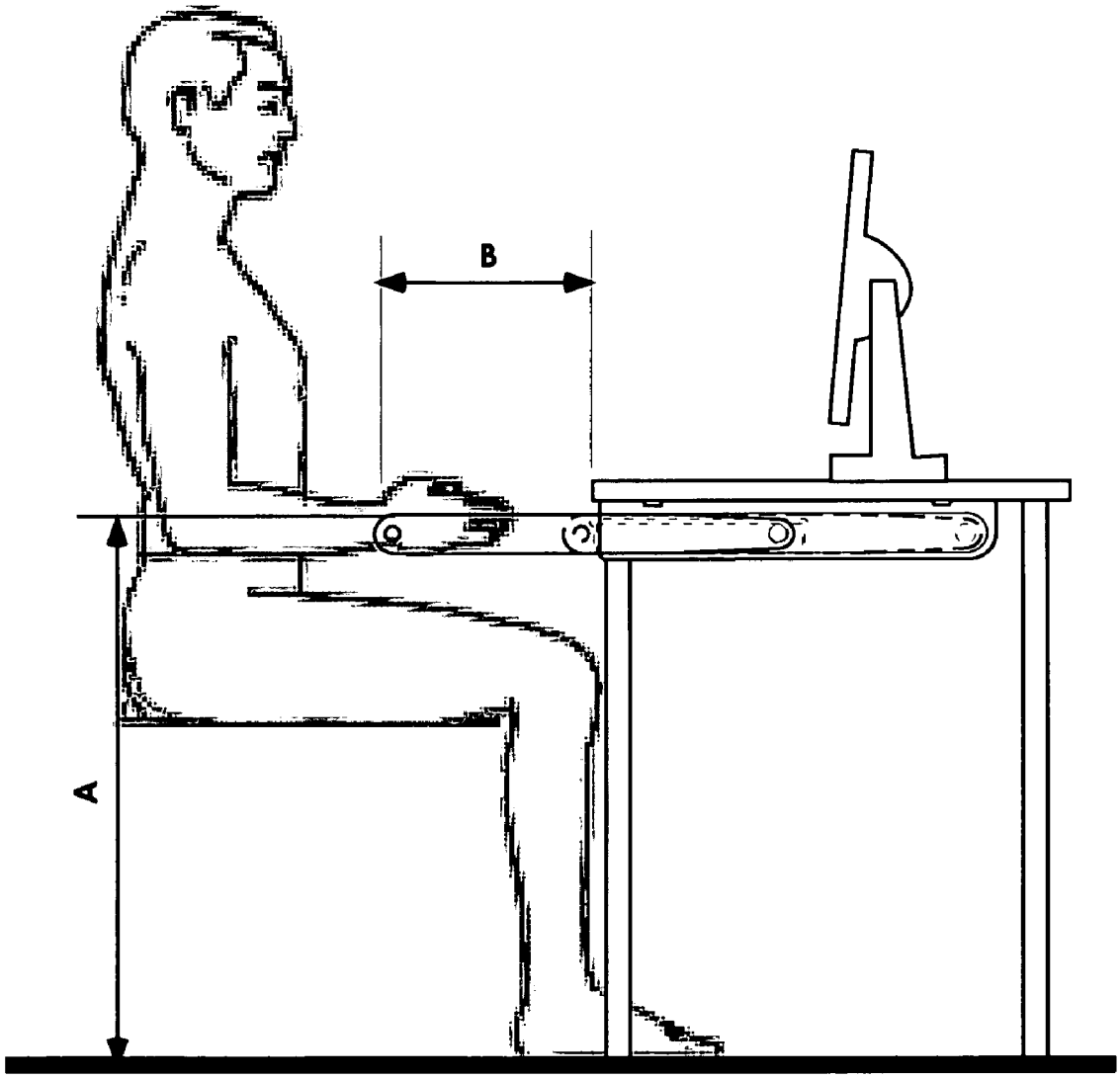
Figure 4: section view showing user at invention when mounted at a typical office desk

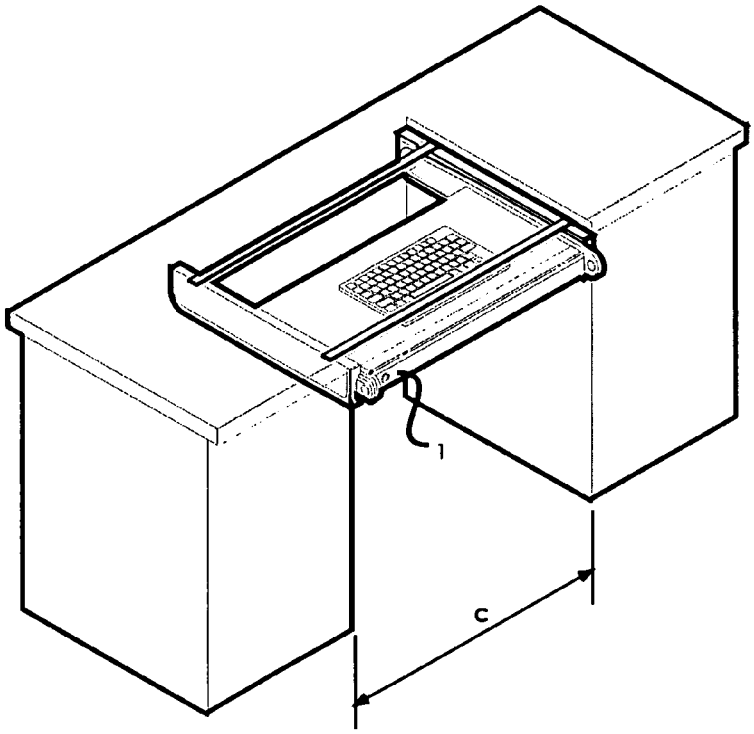
Figure 5: Perspective of invention in closed position under typical office desk
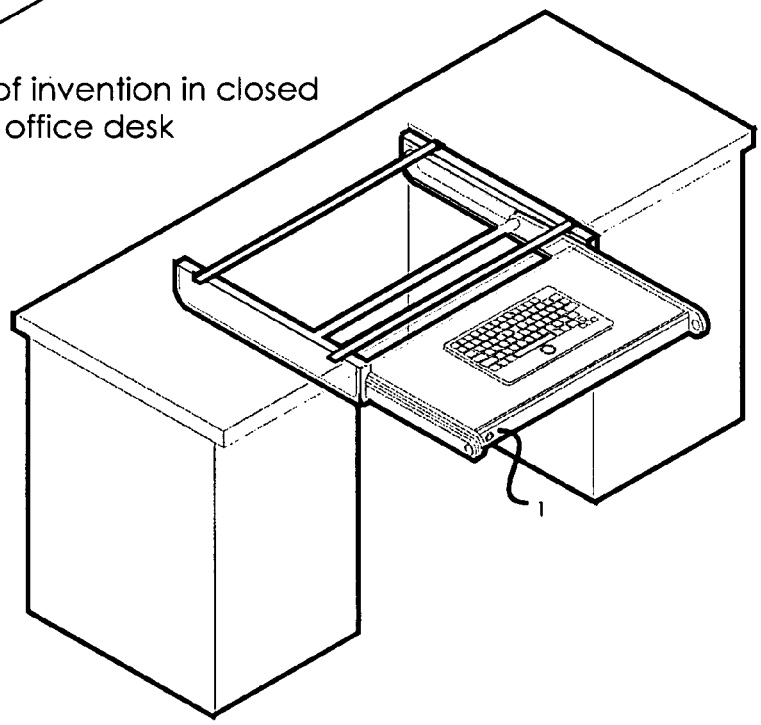
Figure 6: Perspective of invention in open position under typical office desk

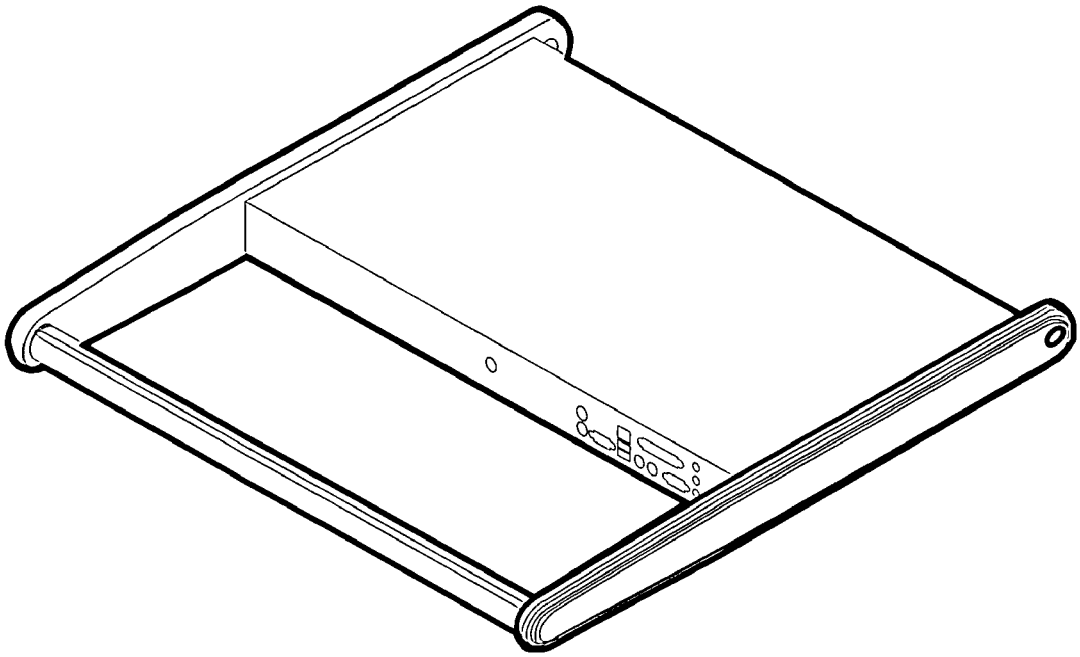
Figure 7: top, back, left-side view of Figure 1 in an alternative embodiment without a keyboard inset in top of unit

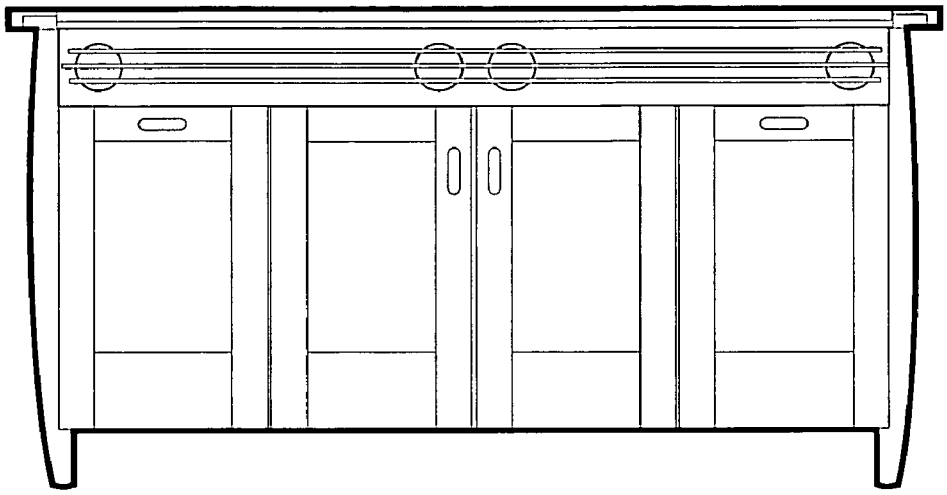
Figure 8: Front elevation of entertainment center furniture with doors closed having alternative embodiment of invention.
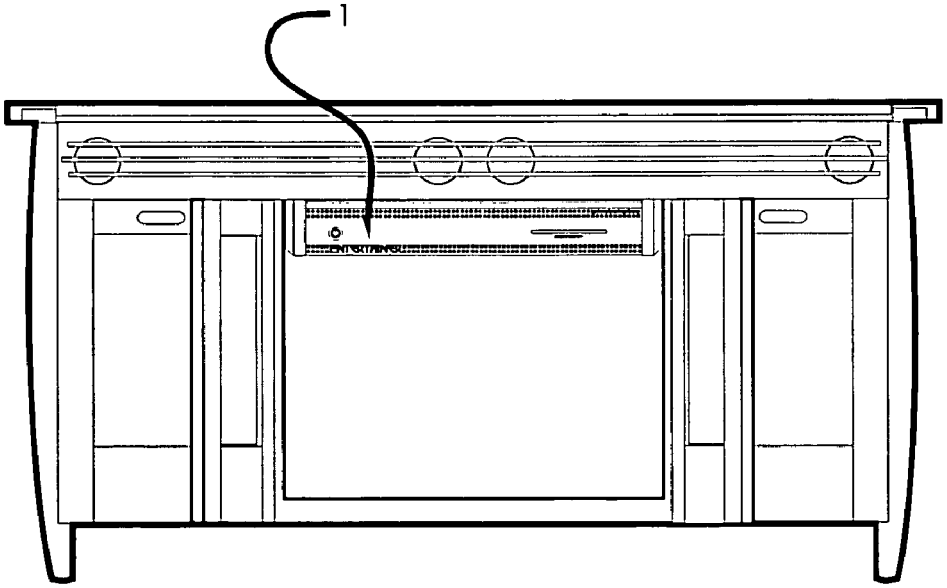
Figure 9: Front elevation of entertainment center furniture with doors open showing alternative embodiment of invention.

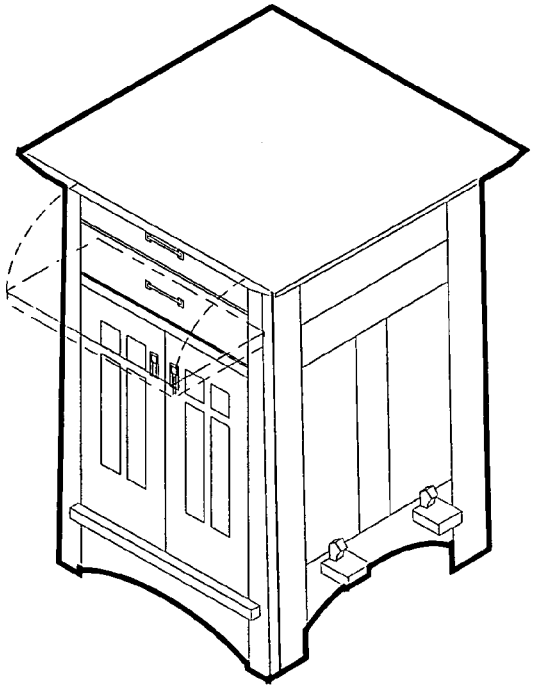
Figure 10: Perspective view of side table with doors closed having alternative embodiment of invention.
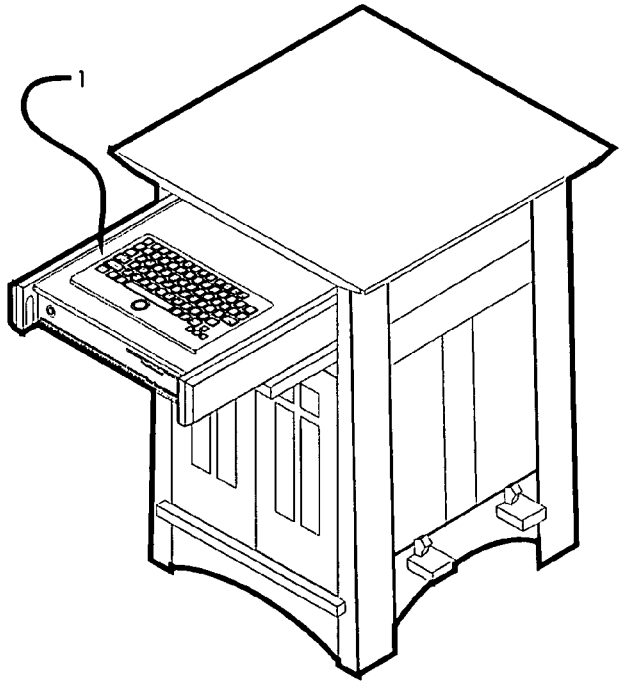
Figure 11: Perspective view of side table with doors open showing alternative embodiment of invention.

METHOD AND APPLIANCE FOR PROVIDING BROADBAND INTERNET SERVICES IN A RETRACTING DRAWER MOUNTED ENCLOSURE

CROSS REFERENCE TO RELATED APPLICATIONS

Not Applicable

FEDERALLY SPONSORED RESEARCH

Not Applicable

SEQUENCE LISTING OR PROGRAM

Not Applicable

FIELD OF THE INVENTION

This invention pertains generally to consumer electronics of a stereo and personal computers, and more particularly to drawer mounted retracting networked appliance.

BACKGROUND OF THE INVENTION

We are at a time of the convergence of the personal computer with audio and video single use appliances. Because the power of the newest CPU's exceeds the requirements for operating typical home or office software applications a niche market has developed for low-power CPU's requiring less than 10 watts to operate which are capable of running home and office software. This market is gaining market share because they can serve as Internet appliances and multimedia players without the need for cooling fans thus creating a nearly silent computer. Such a computer can be placed inconspicuously in any home or office setting and function as a stereo and television in addition to a personal computer. The low-powered processor introduced by VIA as the EPIA M series in 2002 was joined in the spring of 2004 by the Geode NX line by AMD. Intel is planning a line of low powered CPU's called the Dothan range of Pentium M mobile to be introduced in 2005-06.

Low-powered processors enable computers to be welcome anywhere in a home or office, but it is the Internet that is driving the need for convergence appliances. Specifically, it is high-speed broadband Internet. Using broadband a user can receive video at broadcast quality (full-screen at 30 fps). There are a number of Internet companies offering subscription services for radio, music, and video programming including Apple Computer, Microsoft, MusicMatch, Real Networks and Roxio. Broadband Internet holds the promise to expand into programming identical to broadcast media thus challenge cable and satellite TV companies for program selection and interactive offerings. In addition, to increase competition for local telephone service the FCC has approved voice over Internet protocol, VoIP. While corporations have had VoIP for some time companies, such as Clearwire and Vonage, now offer consumers VoIP via a broadband Internet connection.

Finally, while low-powered processors have opened all rooms in the home and places in the office to the PC, and the internet has made the PC a multimedia and communications convergence appliance, it is the maturing of wireless networking that has made this invention viable. The electromagnetic spectrum is divided between low power for LAN providing homes and offices interconnectivity and high-power that allow as for municipal wide broadband networking. This invention is made to be part of a home or office LAN, and a municipal broadband network.

Therefore, a purpose of this invention is to provide an appliance that incorporates internet and personal computer functions that is welcome in any room of a home or place in an office and that can be networked to other embodiments of this invention and other network enabled appliances.

Existing computer, audio and video appliance art utilize old designs and are not made to take advantage of internet services made feasible by broadband internet. Personal computer manufacturers having been focusing resources on making portable connectivity tools, such as Apple Computer's iPod, various PDA's, ever smaller portable computers and smart phones. Little has been done to address a stationary convergence broadband Internet appliance other than to make smaller form factor computers or desktop all-in-one units that while usable are not convenient to use, nor offer hi-fi quality sound, nor are they seamlessly integrated. All computer based broadband appliances were created originally as word-processors not as multimedia Internet appliances, whereas this invention is made explicitly for broadband Internet service offerings into a single easy to use appliance.

Audio and video equipment manufacturers offer DVD/CD players that can read MP3 files on CDR disks and make receivers that may have an Ethernet connection to serve as an audio appliance for a networked home. Startup companies are building media hubs and digital video recorders to time-shift media programs for user benefit. Each of these manufacturers is addressing single purpose appliances and not a convergence broadband Internet appliance.

U.S. Pat. No. 5,587,877 (Ryan) describes a mounting arrangement for computers. Ryan's solution has nothing to do with being an ergonomic work-surface with all computing and electronics housed in a single unit, nor is it is portable. It also does not contain an audio amplifier. It also does not provide an integrated input means. And finally, it is not used as the work surface for the user.

U.S. Pat. No. 7,042,716 (Shearman) describes another mounting arrangement for computers. Though it at least mounts in front of the user, it is not portable; it does not provide an integrated input means, nor does it contain an audio amplifier for internet appliance use.

OBJECTS AND ADVANTAGES

Accordingly, besides the objects and advantages of the retractable drawer mounted broadband internet appliance described in my above patent, several objects and advantages of the invention are:

(a) to provide a single appliance for the home or office that has an array of useful functions and capabilities at the fingertips of the human user.

(b) to provide an appliance with hard wired user control input means such as a keyboard, touch-pad, game console, specialized keyboard, or touch-screen, but not limited to these that improves on present art which uses wireless input devices which are unreliable with missed keystrokes caused by battery drain and line-of-sight or frequency interference.

(c) to provide the user with an Internet appliance that can be placed inconspicuously in any room of a home or any office because it is quiet and can be finished in a variety of materials, in an array of colors and textures.

(d) to provide the user with an ergonomic appliance the invention addresses the shortcoming of the present art by placing the input controls, such as a keyboard and track-pad (see FIG. 2) on the top of an enclosure that is mounted underneath a desktop and at a height to best accommodate the user. Existing computer, audio and video hardware products do not address ergonomics. The input device, usually a keyboard, is usually placed on top of the work-surface as an afterthought, or the user is required to place it on their lap at a couch.

(e) to provide a portable Internet appliance that may be moved from location to location such as between home, office, and vacation home.

(f) to provide a Internet appliance that can be secured to the desktop to make theft difficult and provided with child-proof lock to keep it closed to protect a child or allow the parent to control access if desired. Existing computer and audio and video art is free standing and thus can be easily stolen, and because it is exposed it can be a hazard to children.

(g) to provide an Internet appliance that places the electronics off the floor thus reducing the amount of air-borne particulates and dust that can accumulate within and on the electronic components. Existing computer systems are placed on floors or on work-surfaces and are surrounded by cables and power cords collecting significant air-borne particulates shortening the life of electronic components and creating a fire hazard.

(h) to provide a Internet appliance that connects wirelessly to other wi-fi enabled appliances for a networked environment, such as in network linking several of these inventions in the same or different embodiments wirelessly throughout the home, office, or retailer as video, music, and software servers, connected to an internet gateway, and sharing printers and scanners alike.

(i) to provide in an alternate embodiment of the invention a plurality of amplifiers that matches the performance of high quality home bookshelf systems. High-fidelity audio is not incorporated into present computer systems. Manufacturers of existing audio and video systems do not include computer systems, nor do they combine into one package video and audio amplification.

( ) to provide a portable game computer that a user may use for LAN parties.

(k) to provide a space saving Internet appliance when mounted in rows such required at call centers and libraries.

(l) to provide for a low-energy, off-grid multimedia appliance at a remote site, such as a mountain or lakeside cabin.

(m) to provide a multimedia appliance that may be used in a recreational vehicle or on a sailing or motor yacht with DC power.

Additional objects, advantages, and novel features of the invention are set forth in the description that follows and will become apparent to those skilled in the art when taken in conjunction with the accompanying drawings. The objects and advantages of the accommodations particularly pointed out in the appended claims.

SUMMARY

It is therefore an object of the present invention to provide a retractable drawer mounted Internet appliance that saves floor space and improves user ergonomics over existing art. The enclosure integrates user input controls and functions and as a retracting keyboard shelf. The invention can be finished in a variety of materials, in an array of colors to make it appealing to users in any office or home environment. It may have a high-fidelity multi-channel amplifier for audio use, be connected wirelessly to a LAN as part of a network and for Internet access.

DRAWINGS—FIGURES

FIG. 1: top, front, right-side perspective of this invention

Figure 2:
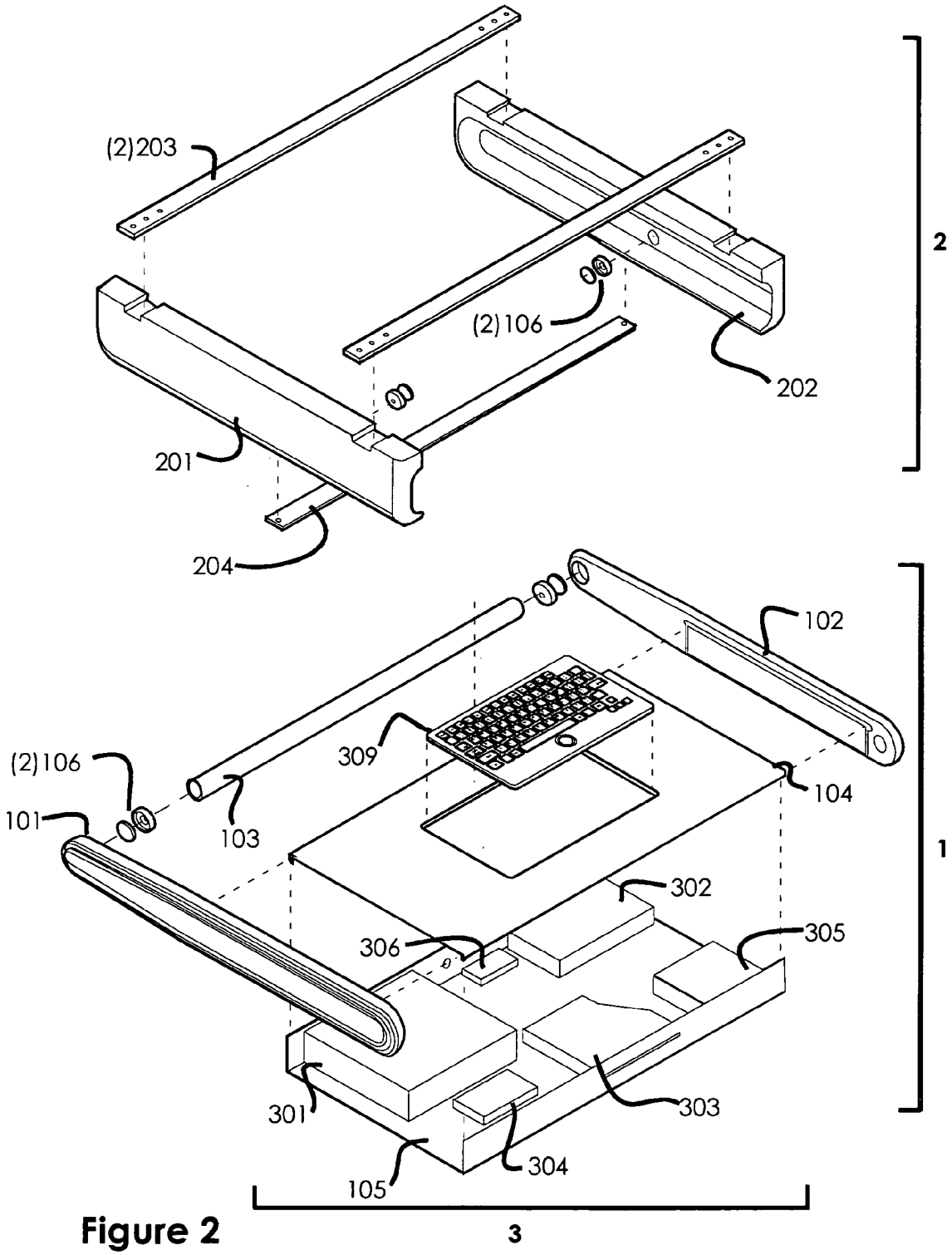

FIG. 2: top, front, left-side exploded perspective view of FIG. 1

FIG. 3: Perspective of invention of FIG. 1 being carried by a user

FIG. 4: section view showing user at invention when mounted at a typical office desk FIG. 5: Perspective of invention in closed position under typical office desk FIG. 6: Perspective of invention in open position under typical office desk FIG. 7: top, back left-side view of Figure one in an alternative embodiment without a keyboard inset in top of unit FIG. 8: Front elevation of entertainment center furniture with doors closed having alternative embodiment of invention FIG. 9: Front elevation of entertainment center furniture with doors open showing alternative embodiment of invention FIG. 10: Perspective view of side table with doors closed having alternative embodiment of invention FIG. 11: Perspective view of a side table with doors open showing alternative embodiment of invention

DETAILED DESCRIPTION—FIGS. 1-7—PREFERRED EMBODIMENT

The parts that make up the invention in its best (preferred) form include two assemblies as shown in FIG. 1, slide assembly (2), and Internet appliance (1).

The slide assembly (2), FIG. 1, enables the said appliance to be mounted under a desk and used as a keyboard shelf.

FIG. 2 shows the enclosure assembly chassis (3) with appliance left-side rail (101) and appliance right-side rail (102), which are made of solid-core plywood, of predetermined dimensions and routed to shape as shown and finished with aniline dyes in various colors.

The top surface panel (104) is made of acrylic solid surface such as Dupont Corian or LG Hi-MACS or an equivalent material and routed to shape shown with keyboard hole dimensioned as specified by IKEY Industrial Peripherals model SL-86-911 keyboard (309). This panel is made of a material rigid enough to not flex under use as a keyboard surface and treated to shield EMI and RFI. The top surface panel (104) is permanently attached to the said rails (101) and (102) within the slots on the inside faces of the rails and secured with epoxy.

The stress relief bar (103) is made of 6000 series aluminum-magnesium-silicon alloy tube of predetermined diameter and length. It is also used as a carry bar to hold when carrying the enclosure from place to place. The stress relief bar (103) is permanently attached to the enclosure with the holes drilled at the back of the two side rails where the magnetic slide stop assemblies (106) are also placed.

The electronic chassis (105) is formed from a single piece of 18-gauge aluminum of predetermined dimensions and electronic quick release trays welded in place. Alternatively the chassis may be made of injection molded plastic or other method. The electronic chassis (105) is meant to be removable and is attached to the left-side rail (101) and right-side rail (102) within slots for front and back face panels and along the bottom panel of the electronic chassis with fasteners attached to the left-side rail (101) and right-side-rail (102) with fastener inserts. Alternatively, the electronic chassis (105) may be attached with each end of the front and back panels formed into sleeves that press fit into the left-side rail (101) and right-side rail (102) and held in place with inserts that expand the sleeves for a friction fit.

Housed within electronic chassis (105) is a motherboard (301), such as a VIA EPIA M, storage media (304), wired Ethernet—which is part of the motherboard (301), and wireless blue-tooth and wi-fi (306) and dc-dc connector (302) as the unit uses an external power supply, but an alternative could be to use an internal power supply (302).

The slide assembly (2), FIG. 2, is made of the left-side slide (201) and right-side slide (202) are made of molded polycarbonate with inside surfaces modeled to match left-side rail (101) and right-side rail (102) respectively. The magnetic slide stop assemblies (106) are permanently fastened to the left-side slide (201) and right-side slide (202) and are placed so that the magnetic slide stop assemblies (106) in the left-side rail (101) and right-side rail (102) have magnetic fields opposed to one another so to maximize repelling as the assemblies approach. The upper support bars (203) and lower support bar (204) are made of aluminum and permanently attached to left-side slide (201) and right-side slide (202) with fasteners.

FIGS. 8-12—Additional Embodiments

In another embodiment of the preferred embodiment and housed within the enclosure assembly chassis (3) is a multi-channel amplifier (305) with at least 5 watts per channel for a minimum of two channels and a frequency range of at least 80 Hz to 15K Hz may be housed within the Internet appliance (1) providing amplification to allow the user to attach non-amplified speakers.

In another embodiment and housed within the enclosure assembly chassis (3) as shown in FIG. 7, the keyboard (309) of the preferred embodiment of FIG. 1 and FIG. 2 is not installed and the top is left as a single uninterrupted surface so that the user may place a keyboard and mouse of their own selection.

In another embodiment and housed within the enclosure assembly chassis (3) as shown in FIGS. 10-11, the drawer mount Internet appliance (1) is shown narrower than the preferred embodiment and placed in a Stickley style side table for use as a personal computer and stereo system and can be part of a home network.

In another embodiment and housed within the enclosure assembly chassis (3) as shown in FIGS. 8-9, the drawer mount Internet appliance (1) is shown wider than the preferred embodiment. This embodiment includes 5-channel amplifiers (305) and is placed in an entertainment cabinet with a plurality of speakers wired into the cabinet serving as a self-contained audio and video entertainment system.

The enclosure assembly chassis (3) could made deeper, narrower or wider depending on the needs of the hardware or application, such as FIGS. 8-11 showing different embodiments of the invention adapted for home entertainment use.

The integrated keyboard and touch-pad (309) of the preferred embodiment could be replaced with a game control console or other user specified input device to tailor it to a specific user requirements.

In another embodiment a portable media storage apparatus (303) may be housed in the Internet appliance (1) such as an optical disk drive, compact flash or other such media.

Operations—FIGS. 3, 4, 5

The manner of using the retracting drawer mounted appliance is first to mount the drawer slide (2) under a table or countertop and slide the Internet appliance (1) into the drawer slide (2). Slide the appliance enclosure past the first resistance caused by the magnetic stop (106). The usable operating slide distance is (B), see FIG. 4. The invention is designed to fit within the user space (C) shown in FIG. 5 of typical office and home furniture made by companies such as Steelcase, Herman Miller, and Hon.

Retract the Internet appliance (1) for use and slide back flush with the face of the countertop when not in use.

When in use the user is seated in front of the appliance, see FIG. 4, and retracts the Internet appliance (1) and turns the power on (307) and uses input controls placed on or within the top surface, such as the keyboard (309).

The unit may be removed for transporting to another location by simply continuing to pull the Internet appliance (1) from the drawer slide (2) past the point where the magnetic stop (106) restricts movement and unplugs the power cable and video cable if used. Carry said broadband Internet appliance using the stress relief bar (103) as a handle as shown by FIG. 3.

Advantages

From the description above, a number of advantages of my retracting drawer mounted appliance become evident:

(a) unlike existing multimedia and computer appliances this invention provides improved ergonomics over existing art. The Internet appliance (1) contains the user input on the top surface and is mounted underneath a desktop and at a height better accommodating the user with forearms horizontal to reduce wrist fatigue.

(b) existing multimedia and computer appliances are unsuited for free standing use in a living room, kitchen, or office, this invention is adaptable because it can be made in a variety of materials, in an array of textures and colors to be compatible with any décor of a home or office.

(c) the invention may be carried from location to location with its stress relief bar (103) and additional drawer slides may be used at different locations and the unit used at LAN and game parties between a users home and RV, yacht, or cabin.

(d) while existing art have hardware components that cannot be upgraded which has led to a landfill problem in many municipalities, this invention is designed so that all components can be replaced. The chassis is sized to accommodate new hardware configurations and the power supply is external and thus adjustable to other voltage and amperage rates.

CONCLUSION, RAMIFICATIONS, AND SCOPE

Accordingly, the reader will see that the retractable drawer mounted appliance has ergonomic benefits; and be inconspicuously used in all rooms of a home or office setting; and can replace audio and PC appliances.

Although the description above contains much specificity, these should not be construed as limiting the scope of the invention but as merely providing illustrations of some of the presently preferred embodiments of this invention. For example, the Internet appliance can have other shapes and sizes; or made of different material, the present invention has been described using plastic, plywood, and metal, it could also be built in a wide range of manufactured parts, including laminated wood, die-cast metal, extruded metal, thixo-molded metal, roto-molded plastic, thermo-molded plastic, formed plastics, ceramics, etc.

Thus the scope of the invention should be determined by the appended claims and their legal equivalents, rather than by the examples given.

SUMMARY

The disclosed invention overcomes the shortcomings of the prior art by providing in a single retractable drawer mounted Internet appliance all services offered by the internet, such as audio, video, and communications. The invention contains a CPU, a high-fidelity audio system with amplification and speakers and a video monitor, such that the appliance can be finished in a variety of materials, in an array of colors and textures to blend into any room at home or office. In addition, the appliance may also include microphones and a video camera to provide telephone and videophone communications.

What is claimed is:

1. A method of providing an Internet appliance that is mounted under a countertop or a desk as a retracting drawer and comprised of the following:

i. a pair of slide rails that mount under a desktop and have inside surfaces that mirror an outside face of a left-side support rail and a right-side support rail for an enclosure assembly chassis, ii. said support rails are slidably placed between said slide rails and assembled with a stress relief bar and said enclosure assembly chassis, iii. said stress relief bar attaches to the rear of said support rails and additionally functions as a carry bar, iv. said enclosure assembly chassis consists of a top, a left-side and a right-side, a bottom and are attached to the forward part of said support rails, v. a plurality of electronic apparatus are housed within said enclosure assembly chassis, v. said plurality of electronic apparatus provides multimedia and personal computer functions, whereas said Internet appliance mounts under the countertop or the desk sliding out for use and in when not in use, whereas a user can remove said Internet appliance and transport it to another location.

2. A method as recited in claim 1, wherein a user controlled input device is mounted within a top surface of said enclosure assembly chassis.

3. A method as recited in claim 1, wherein a plurality of amplifiers are mounted within said enclosure assembly chassis.

4. A method as recited in claim 1, wherein a CPU, a storage media, a wi-fi and a dc-dc connector or a ac-dc connector or ac-dc power supply or dc-dc power supply are mounted within said enclosure assembly chassis.

5. A retracting drawer mounted Internet appliance that mounts under a desk or countertop and has a means of user input control comprising:

a pair of opposing pieces of rigid material of predetermined dimension with inside surface impressed with the shape of an enclosure side rails and attached to the underside of a countertop or desk surface and serve as drawer slides for said Internet appliance, said enclosure side rails are of predetermined dimension and material that are attached to longitudinal ends of an enclosure assembly chassis (3) of front, bottom and back of predetermined dimensions and material, the top of said enclosure assembly chassis is made of predetermined dimensions and material and is a work surface for the user and includes a user input control device integral within the work surface, contained within said enclosure assembly chassis is a CPU, a storage media, and a dc-to-dc connector or a ac-dc connector or ac-dc power supply or dc-dc power supply, a single bar of predetermined diameter and whole rigid material that is attached to back of said enclosure side rails for transporting appliance and for cable relief when in use.

6. The retracting drawer mounted Internet appliance of claim 5 wherein: a variety of wireless outputs such as wi-fi, bluetooth, and infrared may be included in said enclosure assembly chassis.

7. The retracting drawer mounted Internet appliance of claim 5 wherein: a variety of portable storage media apparatus such as an optical disk, a slot reader for compact flash, a smart media, etc may be included in said enclosure assembly chassis.

8. The retracting drawer mounted Internet appliance of claim 5 wherein: a plurality of amplifiers may be included in said enclosure assembly chassis.

9. A retracting drawer mounted Internet appliance that mounts under a desk or countertop comprising:

a pair of opposing pieces of rigid material of predetermined dimension with inside surface impressed with the shape of enclosure side rails and attached to the underside of a countertop of desk surface and serve as drawer slides for the Internet appliance, the said Internet appliance is made said enclosure side rails of predetermined dimension and material that are attached to the longitudinal ends of a enclosure assembly chassis of front, bottom and back of predetermined dimensions and material, the top of the enclosure assembly chassis is made of predetermined dimensions and material and is the work surface for the user, contained within said enclosure assembly chassis is a CPU, a storage media, and a dc-to-dc connector or a ac-dc connector or ac-dc power supply or a dc-dc power supply, a single bar of predetermined diameter and whole rigid material that is attached to back of said enclosure assembly chassis side rails for transporting appliance and for cable relief when in use.

10. The retracting drawer mounted Internet appliance of claim 9 wherein: a variety of wireless outputs such as wi-fi, bluetooth, and infrared may be included in said enclosure assembly chassis.

11. The retracting drawer mounted Internet appliance of claim 9 wherein: a variety of portable storage media apparatus such as an optical disk, a slot reader for compact flash, a smart media, etc may be included in said enclosure assembly chassis.

12. The retracting drawer mounted Internet appliance of claim 9 wherein: a plurality of amplifiers may be included in said enclosure assembly chassis.

* * * * *